US006447407B1

(12) United States Patent
Caldwell

(10) Patent No.: US 6,447,407 B1
(45) Date of Patent: Sep. 10, 2002

(54) GOLF ACCESSORY DEVICE

(76) Inventor: Darrell S. Caldwell, P.O. Box 1050, Glen Rose, TX (US) 76043

( * ) Notice: Subject to any disclaimer, the term of this patent is extended or adjusted under 35 U.S.C. 154(b) by 0 days.

(21) Appl. No.: 09/707,471

(22) Filed: Nov. 7, 2000

(51) Int. Cl.[7] ..... A63B 57/00
(52) U.S. Cl. ..... 473/408; 294/19.2; 473/286
(58) Field of Search ..... 473/285, 286, 473/406, 408, 386; 294/19.2, 19.3, 19.1

(56) References Cited

U.S. PATENT DOCUMENTS 4,313,604 A * 2/1982 Baxter ..... 294/19.2
4,313,632 A * 2/1982 King ..... 294/19.2
4,522,438 A * 6/1985 Logue ..... 294/19.2
4,951,947 A 8/1990 Kopfle
4,951,951 A * 8/1990 Meyer ..... 473/286
5,029,854 A 7/1991 Laskowitz et al.
5,037,150 A * 8/1991 Vecchi ..... 294/19.2
5,149,087 A * 9/1992 Thompson, Jr. ..... 473/286
5,165,744 A * 11/1992 Vogrin ..... 473/386
5,209,469 A 5/1993 Laskowitz et al.
5,765,647 A * 6/1998 Hood ..... 473/408
6,095,935 A 8/2000 Gooselaw et al. ..... 473/408

* cited by examiner

*Primary Examiner*—Steven Wong
(74) *Attorney, Agent, or Firm*—Bracewell & Patterson LLP

(57) ABSTRACT

A golf accessory device is shown which includes a shaft having a first and second oppositely arranged shaft ends. A ball retrieval suction cup is affixed to the first shaft end. A ball mark repair tool is affixed to the oppositely arranged second shaft end. A hook located at approximately the ball mark repair tool on the shaft is sized for use in picking up objects which are lying in a horizontal position on a surrounding playing surface.

5 Claims, 2 Drawing Sheets

GOLF ACCESSORY DEVICE

BACKGROUND OF THE INVENTION

1. Field of the Invention

The present invention generally relates to accessory devices used in the game of golf and, specifically, to an accessory device which eliminates the need to bend when performing several of the typical functions involved in play.

2. Description of the Prior Art

Persons with bad backs, knees, or hips often find it extremely difficult to repeatedly bend over to perform several typical activities associated with playing the game of golf. For example, these persons often find it difficult to retrieve the golf ball from the cup after the ball has been putted into the cup.

Bending is also required for retrieving objects which lie on the horizontal playing surface, for example putters or other clubs, flags and other objects.

Another activity which is commonly required involves repair to specific locations upon a golf course during play such as the ball marks which are formed upon the surface of a green. The golfer should repair the damaged green by pulling up the newly formed ball mark or depression. The conventional tools available for performing this operation require the user to bend over or kneel down and repair the damage. This is again an uncomfortable operation for some golfers, particularly the elderly or the physically challenged. Because it is physically difficult for some golfers to perform these operations, they will sometimes leave the green damaged without repair.

The typical ball mark turf repair tool is a hand held device with two prongs extending outwardly from a body. The user grasps the relatively small tool in the bare hands and must bend over near the damaged area being repaired. The user then inserts the conventional tool into the damaged playing surface and twists the tool to repair the damaged surface.

For some persons, the hand held repair tool is not a desirable solution to the problem of repairing golf turf because the requirement of physically bending over to the ground. As previously discussed, in addition to the simple inconvenience, some golfers are physically incapable of repairing ball marks or depressions in this manner.

A need exists, therefore, for a golf accessory device which would allow a player to perform many of the tasks which now require bending from an upright position.

A need exists for such an accessory device which will stand by itself so the player does not bend over to retrieve the device, before performing other functions.

A need also exists for such a device which is simple in design and economical to manufacture.

A need also exists for such a device which would have a pleasing esthetic appearance.

A need also exists for such a device which would combine multiple operational functions into a simple elongate tool or member.

SUMMARY OF THE INVENTION

The foregoing needs are met by the golf accessory device of the invention which includes a shaft having a first and second oppositely arranged shaft ends. A ball retrieval suction cup is affixed to the first shaft end. A ball mark repair tool is affixed to the oppositely arranged second shaft end. A hook is located at approximately the ball mark repair tool location on the shaft, the hook being sized for use in picking up objects lying in a horizontal position on a surrounding playing surface.

The ball retrieval suction cup has a cup opening of a preselected diameter to allow the cup to grip and lift a golf ball. The ball mark repair tool is a multi-bladed fork type device, the blades of which extend in a direction generally opposite the shaft for engaging the surrounding playing surface and repairing the surface during play. Preferably, the shaft has a golf grip region adjacent the first shaft end.

The accessory device of the invention can also be provided with a clamp-like device attached to the shaft at a point intermediate the opposing shaft ends. The clamp-like device has a clamp opening sized to receive a cigarette to temporarily hold the cigarette during play. An attachment clip can also be located on the shaft intermediate the opposing ends thereof for attaching the golf accessory device to a golf bag or other support during play.

Additional objects, features and advantages will be apparent in the written description which follows.

DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
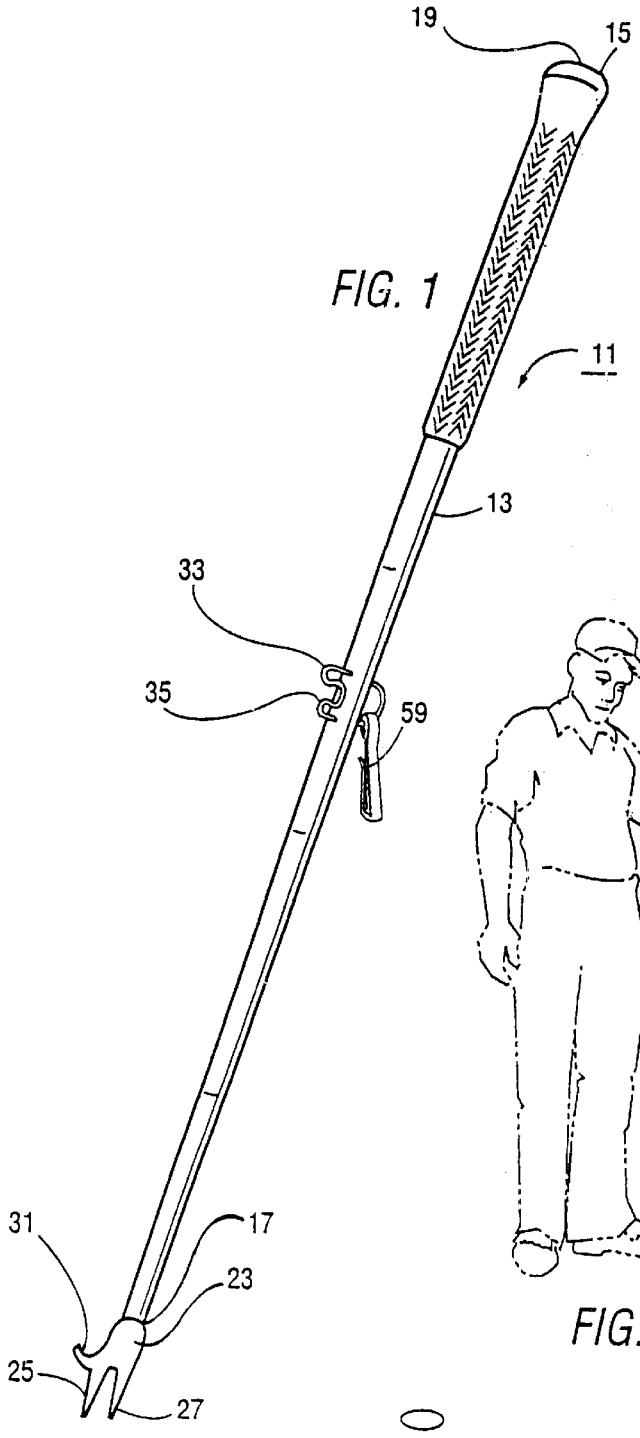
FIG. 1 is a perspective view of the golf accessory device of the invention.

Turning to FIG. 1, there is shown a golf accessory device of the invention designated generally as 11. The accessory device 11 includes a generally tubular shaft 13 having a first shaft end 15 and a second, oppositely arranged shaft end 17. The shaft 13 can be formed of a variety of materials including a suitable lightweight metal or metal alloy such as aluminum or a synthetic or polymeric material such as fiberglass.

Figure 5A:
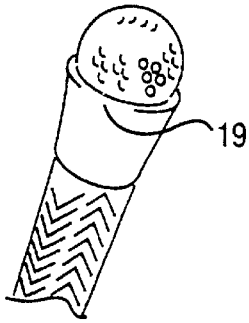
FIGS. 5A and 5B are isolated views of the ball retrieval suction cup of the device showing a ball being engaged within and removed from the cup.
Figure 5B:
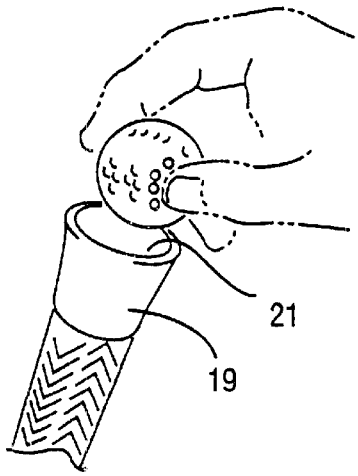

The first shaft end 15 has a ball retrieval suction cup 19 affixed thereto. The ball retrieval suction cup has a cup opening (21 in FIG. 5B) of preselected diameter to allow the cup to grip and lift a golf ball. Preferably, the ball retrieval suction cup 19 is formed of a resilient, elastomeric material, such as a suitable natural or synthetic rubber or a suitable synthetic polymeric material. The resilient nature of the material allows a ball to be gripped and lifted as illustrated in FIGS. 5A–5B.

Figure 4:
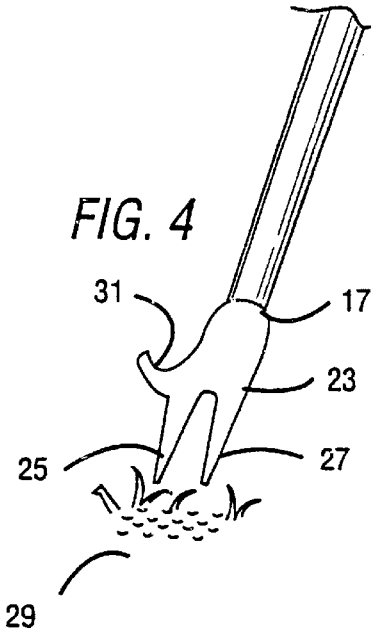
FIG. 4 is a similar isolated view of the ball mark repair tool and hook of the device.

A ball mark repair tool 23 is affixed to the oppositely arranged second shaft end 17. The ball mark repair tool is preferably a multi-bladed fork type device. The blades 25, 27 extend in a direction generally opposite the shaft 13, as shown in FIG. 1, for engaging the surrounding playing surface (29 in FIG. 4) and repairing the surface during play.

Also when inserted into the ground, the device will stand by itself.

Figure 2:
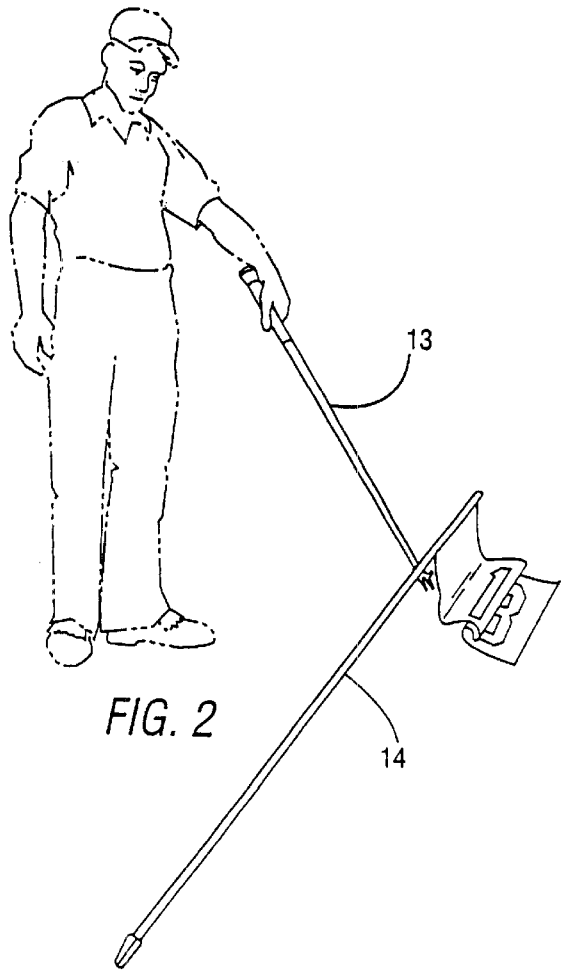
FIG. 2 is a view illustrating one use of the accessory device of the invention, the user being shown in dotted lines.

A hook 31 is located at approximately the location of the ball mark repair tool 23 on the shaft. Preferably, the hook 31 is formed integrally with the ball mark repair tool 23 as by stamping the repair tool and hook from a suitable light-weight metal. Also, the repair tool and hook could be molded from a suitable plastic or synthetic material. The hook is selectively sized for use in picking up objects, such as a flag or club (see FIG. 2) which is lying in a horizontal position on the surrounding playing surface.

Figure 3:
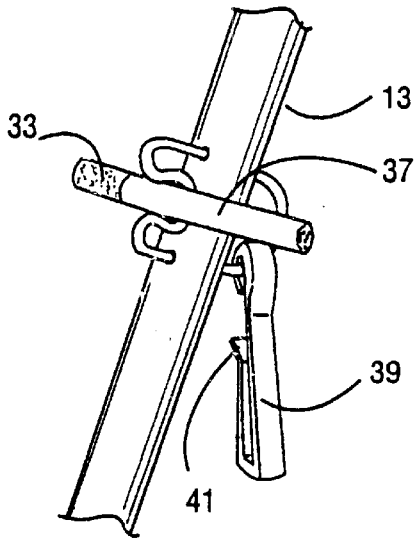
FIG. 3 is an isolated view of a portion of the shaft of the accessory device showing the clamp-like device attached to the shaft.

A clamp-like device (33 in FIG. 1) can be attached to the shaft 13 at a point intermediate the opposing shaft ends 15, 17. The clamp-like device 33 has a clamp opening 35 which is sized to receive a cigarette (37 in FIG. 3) to temporarily hold the cigarette during play. An attachment clip (39 in FIG. 3) can also be provided on the shaft intermediate the opposing ends thereof for attaching the golf accessory device to a golf bag or other support during play. In the embodiment shown in FIG. 3, the attachment clip 39 is a U-shaped metal body having a clip opening 41.

The operation of the device will now be described. To retrieve a golf ball, the accessory device utilizes the ball retrieval cup 19 by pressing the cup down over the ball to retrieve the ball without bending or stooping. The ball can then be easily removed by hand, or shown in FIGS. 5A and 5B. Similarly, the ball mark repair tool, located at the opposite extent of the shaft, allows a ball mark to be repaired by inserting the fork-like blades into the green or surrounding surface and slightly twisting and lifting the sod to repair the ball mark. Again, this function can be achieved without bending or stooping. The small retrieval hook located at or adjacent the ball mark repair tool extends at an angle from the repair tool forks so that it can hook objects which may be lying in a horizontal position on the golf green or surrounding playing surface. These items can then be hooked and lifted by raising the accessory device without the necessity of bending or stooping.

When using the golf accessory device of the invention to perform the aforementioned operations, the device itself will stand when the green repair tool is inserted into the ground, thus allowing the golfer to retrieve the accessory device without bending or stooping.

An invention has been provided with several advantages. The accessory device of the invention is simple in design and economical to manufacture and minimizes or eliminates the bending or stooping operations generally required during golfing play. The product greatly enhances the golfing experience for people who have trouble bending or stooping as a result of injury, age or physical handicap.

While the invention has been shown in only one of its forms, it is not thus limited but is susceptible to various changes and modifications without departing from the spirit thereof.

What is claimed is:

1. A golf accessory device, comprising:

a shaft having first and second oppositely arranged shaft ends;

a ball retrieval suction cup affixed to the first shaft end;

a ball mark repair tool affixed to the oppositely arranged second shaft end at a selected location;

a hook located at approximately the location of the ball mark repair tool on the shaft, the hook being sized for use in picking up objects lying horizontal on a surrounding playing surface;

a clamp-like device attached to the shaft at a point intermediate the opposing shaft ends, the clamp-like device having a clamp opening sized to receive a cigarette to temporarily hold the cigarette during play; and an attachment clip, located on the shaft intermediate the opposing ends thereof, for attaching the golf accessory device to a golf bag or other support during play.

2. The golf accessory device of claim 1, wherein the ball retrieval suction cup has a cup opening of a preselected diameter to allow the cup to grip and lift a golf ball.

3. The golf accessory device of claim 1, wherein the ball mark repair tool is a multi-bladed fork type device, the blades of which extend in a direction opposite the shaft for engaging the surrounding playing surface and repairing the surface during play.

4. The golf accessory device of claim 1, wherein the shaft has a golf grip region adjacent the first shaft end.

5. The golf accessory device of claim 3, wherein the ball mark repair tool is formed of metal and wherein the hook is formed integral with the ball mark repair tool and extends outwardly therefrom in a direction generally perpendicular from the direction of extension of the blades thereof.

* * * * *